US010327570B2

(12) United States Patent
Hunter et al.

(10) Patent No.: US 10,327,570 B2
(45) Date of Patent: Jun. 25, 2019

(54) PRODUCT DISPLAY AND SYSTEM

(71) Applicant: Dunlop Sports Company Limited, Kobe (JP)

(72) Inventors: David Hunter, Huntington Beach, CA (US); Eli Miller, Huntington Beach, CA (US); Chris Beck, Huntington Beach, CA (US)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 138 days.

(21) Appl. No.: 14/477,697

(22) Filed: Sep. 4, 2014

(65) Prior Publication Data

US 2016/0066712 A1 Mar. 10, 2016

(51) Int. Cl.
*B65D 30/22* (2006.01)
*A47F 7/00* (2006.01)

(52) U.S. Cl.
CPC ..... *A47F 7/0028* (2013.01)

(58) Field of Classification Search
CPC ..... A63B 55/00; A63B 55/10; A63B 55/007; A63B 55/008; A63B 55/005
USPC ..... 206/315.1, 315.2, 315.5, 315.6; 224/257, 224/584, 613, 601, 675; D3/204, 228, D3/255
See application file for complete search history.

(56) References Cited

U.S. PATENT DOCUMENTS 2,010,166 A * 8/1935 Thompson ..... A63B 55/00 206/315.6
3,749,233 A * 7/1973 McCormick, Jr. ..... A45C 11/26 206/373
3,850,117 A * 11/1974 Martinelli ..... A47B 3/00 108/150
5,117,724 A * 6/1992 Gardner ..... G10D 13/003 206/314
8,584,861 B2 11/2013 Porath
2009/0178950 A1* 7/2009 Quartarone ..... A63B 53/00 206/579

* cited by examiner

*Primary Examiner* — Fenn C Mathew
*Assistant Examiner* — Cynthia Collado
(74) *Attorney, Agent, or Firm* — Stetina Brunda Garred and Brucker; Mark B. Garred

(57) ABSTRACT

A product display and product display system is disclosed comprising a generally planar top panel and a side panel, the product display intended to comprise or be positionable over a hard, raised generally planar surface having a first size and shape, the generally planar top panel having a second size and shape substantially corresponding to the first size and shape, the product display further comprising on the side panel a plurality of generally vertical longitudinal sleeves.

14 Claims, 2 Drawing Sheets

PRODUCT DISPLAY AND SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Technical Field of the Invention

This disclosure is directed toward a display assembly, and more particularly a collapsible and portable display and system for the presentation of golf club shafts wherein a supported generally planar surface provides most of the support for the display system.

2. Description of the Related Art

In the golfing industry, it is important that the club manufacturers are able to provide sizing or fitting of their golf clubs to the golfing public. Often, this takes the form of fitting sessions, wherein a representative of the manufacturer visits preordained sites and conducts fittings to determine what specifications would be best suited for each individual golfer. Proper fitting of the clubs involves selecting club head properties such as model, center of gravity properties, lie angles, loft angles, and weights; shaft properties such as length, weight, tip stiffness, flex, and flex point. Of course, the goal is that the golfers will achieve better performance with their fitted clubs and purchase the manufacturer's golf clubs, therefore these sessions are a very important step in the selling process.

Today, a golfer selecting a driver from manufacturers has ten or more different shaft manufacturers to choose from, and some of these manufacturers have as many as twenty different specification options. First, a golfer must decide between steel and graphite, and then the golfer must decide between flexes (Ladies, Seniors, Regular, Stiff, or X-Stiff), or weight (for example, 54 to 88 grams), or torque (which can range, for example, from 2.2° to 4.5°), or launch point (low, medium or high), and some golfers may prefer a shaft that is an inch shorter or longer. It is therefore apparent that it is important for the manufacturer's representative to be able to carry with him or her and be able to present and display a large assortment of shafts with varying specifications.

U.S. Pat. No. 8,584,861, incorporated in its entirety by reference herein, attempts to address one or more of these issues with a portable golf shaft display assembly. However, such an assembly is not readily adaptable to a true fitting scenario, in which, for example, at an outdoor "demo day," manufacturers face crowds of potential customers milling about, in often windy conditions, and with the manufacturer's representative in need of a surface upon which to rest items, including golf club components for examination, presentation, and/or fitting purposes. Moreover, the concepts disclosed in U.S. Pat. No. 8,584,861 include a system that is positioned close to the ground, and therefore is subject to inadvertent kicking or tripping, and includes crossed golf club shafts that may stick out into pedestrian traffic, creating a potential hazard, may be difficult to balance, remove, and replace, and present an unsightly, relatively disorderly, and even threatening/uninviting appearance similar to a pike redoubt or other military barrier. Such prior art concepts also provide little to no opportunity for branding or presentation of marketing materials.

Thus, there is a need in the art for means to allow a manufacturer representative to carry with him/her a large sampling of golf club shafts in a very compact, portable and easily carried case, and most important, one that is easy to set-up and display, and to effectively perform a fitting operation while using.

BRIEF SUMMARY OF THE INVENTION

A product display is disclosed comprising a generally planar top panel and a side panel, the product display intended to be positionable over a hard, raised generally planar surface having a first size and shape, the generally planar top panel having a second size and shape substantially corresponding to the first size and shape, the product display further comprising a plurality of generally vertical longitudinal sleeves on the side panel.

The product display offers several advantages over conventional display devices. For instance, various aspects of the product display may advantageously enable the product display to be used with a generally planar support surface, such as a table, and assume a deployed configuration for displaying products, such as golf clubs during a golf club fitting session. Furthermore, the sleeves of the product display may allow products to be displayed in an appealing and orderly arrangement. The product display may also be easily transitioned from the deployed configuration to a stowed configuration by folding the panels into a small, compact, easy-to-carry shape.

BRIEF DESCRIPTION OF THE DRAWINGS

The features, obstacles and advantages of the present application will become more apparent from the detailed description set forth below when taken into conjunction with the drawings, wherein.

DETAILED DESCRIPTION OF THE INVENTION

Figure 1:
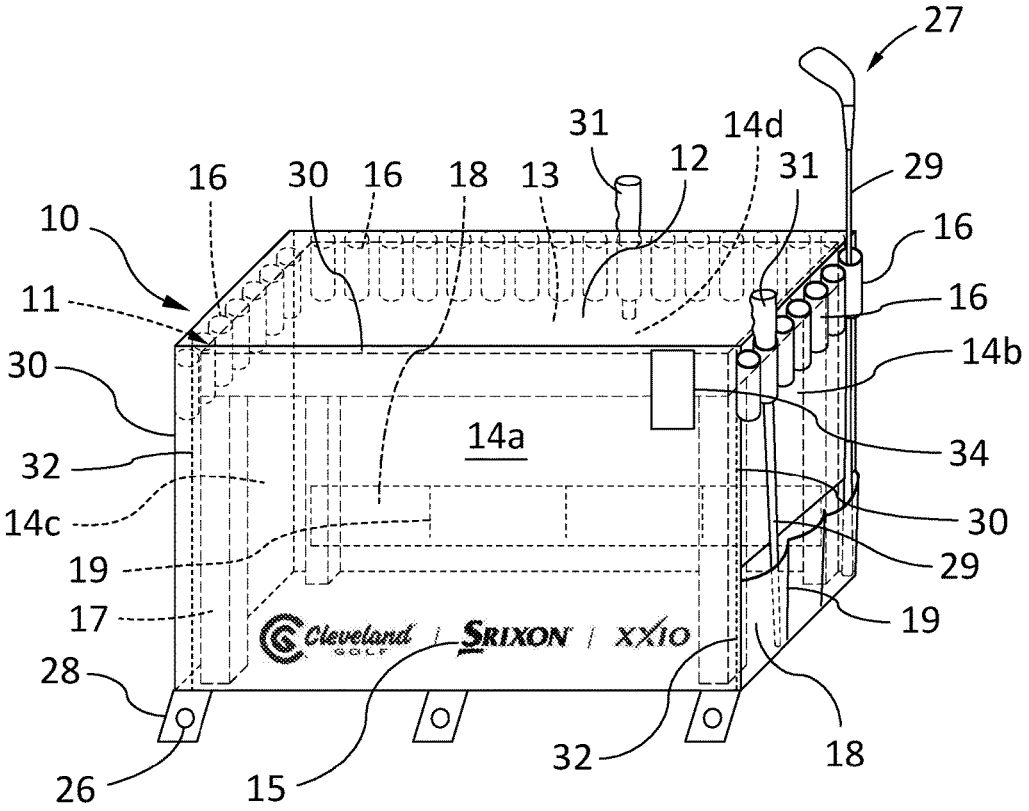
FIG. 1 illustrates a perspective view of a product display and product display system of the present disclosure.

Referring to FIG. 1, there is illustrated an exemplary product display, generally 10, of the present disclosure. The product display 10 may generally comprise a top panel 12 and one or more side panels 14*a-d* having one or more longitudinal sleeves 16 for displaying product (not shown). The product display 10 is specifically configured and adapted to enable quick and easy transport, set up, displaying of product, and stowage of the product display 10. When in use, the product display 10 may display products in an appealing and orderly fashion, which is more likely to attract potential customers.

The top panel 12 and/or side panel(s) 14*a-d* may be fabricated of any convenient material, but preferably comprise a flexible material such as canvas, fabric, plastic sheet, and the like. The side panels 14*a-d* may be fastened to the top panel 12 or contiguous with the top panel 12. If the side panels 14*a-d* are fastened to the top panel 12, one or more fasteners may be used, for example, fasteners that allow the top panel 12 to be removed from the side panel(s) 14*a-d*, such as Velcro™ strips, snaps, hooks, buttons, zippers, or by permanent fastening techniques such as being sewn, glued, riveted, stapled, or otherwise fastened together. In the case of a product display 10 comprising a rectangular or straight-sided top panel 12, the product display 10 may comprise a side panel 14*a-d* attached to one, more, or all of the straight sides of the top panel 12. For example, in the embodiment illustrated in FIG. 1, the top panel 12 comprises four sides, and may thus have a front side panel 14*a*, a right side panel 14*b*, a left side panel 14*c*, and/or a back side panel 14*d*. Other configurations are of course possible. However, it is understood that the top panel 12 is not limited to a quadrangular shape, and may additionally be round, oval, elliptical, polygonal, or a shape with straight and curved segments. As illustrated, one or more of the side panel(s) 14*a-d*, preferably a forward-facing side panel 14*a-d*, may comprise branding and/or marketing indicia 15.

The product display 10 may be positionable over a hard, raised, generally planar surface, such as a table 11 (shown in phantom in FIG. 1). The table 11 may have a top 13 and three or four legs 17. For outdoor use, three legs 17 may be preferred as they may permit more stable placement on uneven ground. Additionally or alternatively, the legs 17 may comprise telescoping shafts that may permit adjustment of the height of the table 11 and/or the leveling thereof. The legs 17 may be foldable for ease of transport and portability. The table top 13 may have any convenient size and shape, and may, for example, be round, square, oval, elliptical, rectangular, irregular, or otherwise. In one aspect, the table top 13 may comprise both straight and curvilinear segments, for example, a rectangular top with rounded corners.

The generally planar surface, such as a table top 13, may have a first size and shape, in the case of the example product display 10 of FIG. 1, a generally rectangular shape, and the top panel 12 may have a second size and shape substantially corresponding to the size and shape of the generally planar surface to allow the product display 10 to neatly and conveniently be positioned thereon, as with a fitted table cloth. However, because the product display 10 is intended to display products, such as golf clubs 27, golf club shafts 29, and golf club grips 31, which together may be of relatively significant weight, the product display 10 should be sufficiently durable and well constructed to resist pulls, tears, product deformation, product spilling out, etc. In this respect, the top panel 12 and side panels 14*a-d* are preferably adapted to be disposable in tension when the products are placed within the product display 10. While the top panel 12 is illustrated in FIG. 1 as a monolithic panel, it is contemplated that the top panel 12 may also comprise a plurality of straps, woven strips, netting, or other configurations that allow the product display 10 and the side panel(s) 14*a-d* to be supported by a raised, generally planar surface, such as a table, and substantially fitted thereto.

As further illustrated in FIG. 1, the product display 10 may comprise on one or more of the side panel(s) 14*a-d* a plurality of generally vertical longitudinal sleeves 16. As used herein, the term "vertical" refers to a direction aligned with gravity. The sleeves 16 are "generally vertical" in the sense that the longitudinal direction of the sleeves 16 has at least one vector component aligned with gravity. In this respect, it is contemplated that the sleeves 16 may be offset from a vertical axis and may still be "generally vertical." In its broadest sense, "generally vertical" may refer to any orientation of the sleeve 16 that is not aligned with a horizontal axis.

According to one embodiment, each sleeve 16 defines a sleeve opening that is adapted to receive a product for display. As illustrated, the sleeves 16 may be positioned proximate the upper portion of the side panel(s) 14*a-d*. Such placement may permit the product, such as the golf club 27 or just its golf club shaft 29, to be more securely positioned in the display 10 than the prior art, as the sleeves 16 may secure the golf club shafts 29 positioned therein. According to one embodiment, the forward-facing or front side panel 14*a* may be free or substantially free of generally vertical longitudinal sleeves 16 in order to permit the branding or marketing indicia 15 to appear unobstructed thereon, and/or to enable a customer to more readily approach the product display 10 and visualize the products being displayed, demonstrated, or discussed. A sales or other representative of the products being displayed may be positioned behind the product display 10, for example, behind the back side panel 14*d* in order to further effective communication of the products being displayed, demonstrated, or discussed.

Figure 2:
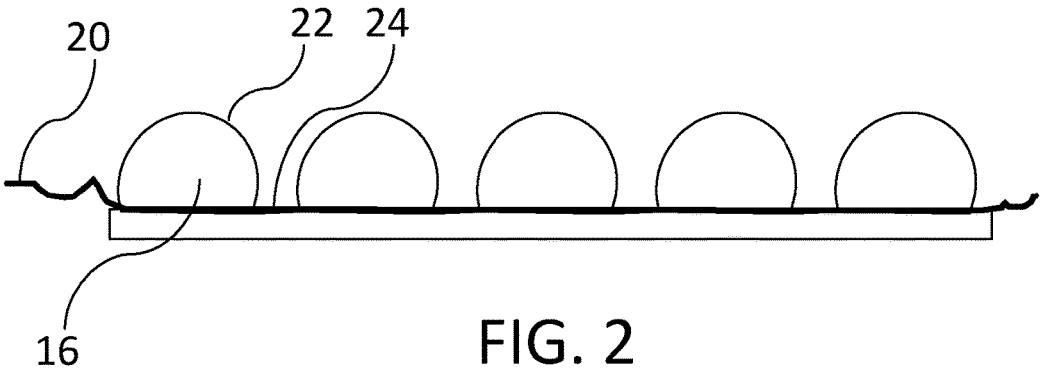
FIG. 2 illustrates a top plan view of a portion of a product display of the present disclosure.

As also illustrated, the sleeves 16 may be spaced closely together and may be of a substantially cylindrical geometry. In one aspect, the sleeves 16 may be formed by using strips of canvas, cloth, or sturdy fabric such as that used for straps or ties, and may be sewn, riveted, or otherwise securely fastened to the side panel(s) 14*a-d*, for example, in a "wave" pattern such as illustrated schematically in FIG. 2. In this aspect, the generally vertical longitudinal sleeves 16 may be formed, for example with a sturdy strap 20 that may, for example, comprise fire hose fabric, canvas, or other robust material. The strap 20 may, as illustrated, be formed into loops 22 and land regions 24. The land regions 24 may be secured to the display, i.e., to the side panel(s) 14*a-d*, for example, by being sewn or riveted thereto. Although the exemplary embodiment shows the sleeves 16 as defining a closed loop, it is understood that in other embodiments, the sleeves 16 may include straps, clips or other devices adapted to maintain the products relative to the side panels 14*a-d* in a desired display orientation.

In yet another aspect, one or more of the plurality of generally vertical longitudinal sleeves 16 may comprise a bottom element extending at least partially across the sleeve opening, such that the sleeve 16 may be configured to retain a first product, such as a sample golf club shaft 29 and/or sample golf club grip 31 therein, without sliding through the sleeve 16. In this aspect, the sleeve(s) 16 may comprise a generally conical or cylindrical member, formed, for example, with a piece of fabric that may be sewn into such configuration and sewn to the side panel(s) 14*a-d*. In this aspect, for example, where the sleeve 16 is configured to display a relatively short elongated product, such as a sample golf club grip 31, the sleeve may be sized to have a depth at least a third as long as the product length, and preferably up to half of the product length or even more, so as to preclude the product from tipping out of the sleeve 16, while permitting at least a top portion of the product, for example golf club grip 31, to be seen for display and removal. Selection of grips 31 comprises one of the aspects of a golf club fitting operation, and thus golf club manufacturers often display multiple grip variations for consumers to choose from. Such grip samples may comprise a grip 31 by itself, or may comprise a grip 31 mounted to a golf club shaft 29 or a short section thereof.

In another aspect, particularly when the display 10 comprises a golf club fitting system, the sleeves 16 may comprise a generally conical geometry, or may be otherwise sized to provide for a relatively tight friction fit when a golf club shaft 29 or sample grip 31 is placed therein.

In another aspect, illustrated in FIG. 1, the product display 10 may comprise at least one of the plurality of generally vertical longitudinal sleeves 16 being bottomless, such that one or more golf clubs 27 and/or one or more sample shafts 29 (i.e., without heads) or other elongated product may slide therethrough. In this aspect, the sleeve(s) 16 may be configured to retain a top portion of a product, such as a golf club shaft 29, on the display 10, and may be positioned generally vertically above a lower pocket 18, which may be positioned proximate the lower portion of one or more of the side wall(s) 14*a-d*, and may be configured to retain a bottom portion of the product, i.e., the distal end of a golf club shaft 29, therein. In this aspect, where both the top portion of an elongated product, for example, a region of a golf club shaft 29 proximate to or including the grip 31, and a bottom portion thereof, for example, the distal end of a golf club shaft 29, are retained, for example by a sleeve 16 and a lower pocket 18, the product may be more readily secured, removed, and displayed, for example, in a substantially vertical orientation. As illustrated, the lower pocket 18 may be divided into two or more sections by dividers 19, which may be formed, for example, by stitching, riveting, etc.

According to another embodiment, a plurality of sleeves 16 may be attached to a common attachment panel (not shown) which is configured to be selectively placed on the side panels 14*a-d* in a desired location. In this respect, the side panels 14*a-d* and attachment panel may include cooperating fastener (e.g., Velcro™, snaps, buttons, etc.) for enabling selective attachment of the attachment panel and the sleeves 16 to the side panels 14*a-d*. The selective attachment of the attachment panel to the side panels 14*a-d* may enable vertical and horizontal adjustment of the sleeves 16 relative to the side panels 14*a-d*.

As further illustrated in FIG. 1, the product display 10 may comprise one or more securing devices 26, 28, such as a grommet 26 and a grommet tab 28 that may permit attachment of the product display 10 to a surface on which the product display 10 rests. In this aspect, if the product display 10 is positioned outside, for example on a grassy surface at a golf demo day, the securing devices 26, 28 may be used with stakes or other devices (not shown) to secure the product display 10 to the ground and reduce the effects of wind and/or consumer traffic on the display 10.

As further illustrated in FIG. 1, the product display 10 may comprise a plurality of individually foldable and flexible side panels 14*a-d*, one or more of which may be securable along a common edge 30 with a fastener 32. The fastener 32 may comprise one or more of snaps, Velcro™ strips, zippers, buttons, ties, etc., which may enable the product display 10 to be broken down and folded or rolled for transport and/or storage. In the broken down configuration, the product display 10, as well as the products retained therein, when rolled or folded, may be placed within a carrying bag (not shown) of appropriate size and shape for ease of portability. The product display 10 may, in a broken down configuration, assume essentially the same shape as a broken down carton or box, but with no bottom, i.e., a box lid.

Although FIG. 1 illustrates only two fasteners 32 on each of the front corners of the product display 10, in this example comprising zippers, it will be readily appreciated that more or fewer fasteners 32 may be employed. For example, in the case of a table having four corners that is covered by the product display 10, all four corners of the product display 10 may comprise a zipper. Particularly, but not exclusively when the fastener(s) 32 comprise a zipper, it may be convenient for the zipper or other fastener 32 to run substantially the entire length of the common edge 30 such that the product display 10 may be more conveniently removed and/or more precisely fitted to a table over which the product display 10 may be positioned. As illustrated, the fastener 32 may be positioned a distance from the common edge 24, or may be positioned substantially along the common edge 24. In other aspects, particularly in the case of a product display 10 having only one side panel and a curvilinear top panel 12, i.e., a circle, only one common edge 24 may exist joined by a single fastening system such as a single zipper. In another aspect, the common edge 24 may alternatively or additionally comprise the edge where the top panel 12 and side panel(s) 14*a-d* join.

In another aspect illustrated in FIG. 1, the product display 10 may comprise an upper pocket 34, for example, in the side panel 14*a-d*, which upper pocket 34 may be configured to retain promotional material, such as product brochures, therein.

It should be here noted that the product display 10 and associated fitting system may be used in a variety of ways to display a variety of products. For example, while a golf club fitting system comprising golf club components such as sample grips and/or sample shafts has been described, it will now be readily appreciated that complete golf clubs may also be displayed using the product display herein described, for example, by displaying the golf club head above the sleeve(s) 16 and running the shaft through the sleeve(s) 16 and/or resting the end of the grip in a lower pocket 18.

As another example, a product display 10 according to the present disclosure may comprise a side panel 14*a-b* that may comprise a flexible wrap-around material with or without a top panel 12 configured to wrap around a table or other raised surface having a substantially planar top surface. In this aspect, the flexible wrap-around material may comprise one or more of the various elements, such as one or more sleeve(s) 16, lower pocket(s) 18 and upper pocket(s) 34 as described herein, but may also include fasteners configured to fasten the wrap-around material to the table or other raised surface, such as snaps, clips, hooks, etc.

Although the foregoing describes the product display 10 as being configured for use with a golf club, it is understood that the product display 10 may be used with other products, including other sporting goods, as well as non-sporting good products.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A golf club fitting system comprising a table having a top surface having a rectangular shape, and a product display positioned about a perimeter of the top surface and fitted thereto, the product display comprising a top panel having a rectangular shape generally corresponding to the top surface rectangular shape, the product display further comprising four vertical panels each having an upper edge connected to the top panel, the vertical panels comprising a front panel, a rear panel, a left side panel, and a right side panel, each vertical panel being secured to an adjacent vertical panel along a common edge via a fastener comprising one of a hook and loop fastener strip, and a zipper, each fastener running substantially an entire length of each common edge, at least one of the vertical panels including a first bottomless longitudinal sleeve retaining a sample golf club shaft without a head having a distal end, the first bottomless longitudinal sleeve being positioned generally vertically above a lower pocket, the sample golf club shaft distal end being retained in the lower pocket, and at least one of said vertical panels including a second bottomless longitudinal sleeve retaining a sample golf club grip without a shaft via a friction fit.

2. The golf club fitting system of claim 1 wherein the first and second bottomless longitudinal sleeves are positioned proximate the top panel.

3. The golf club fitting system of claim 1 wherein at least one of the vertical panels includes the lower pocket, the lower pocket being aligned with at least one of the first and second bottomless longitudinal sleeves.

4. The golf club fitting system of claim 1 wherein at least one of the vertical panels comprises a grommet tab configured to permit attachment of the product display to an adjacent surface.

5. The golf club fitting system of claim 1 wherein at least one of the vertical panels comprises a pocket configured to retain promotional material therein.

6. The golf club fitting system of claim 1 further comprising at least one securing device proximate a lowermost edge of the product display, intended to permit the product display to be attached to a surface on which the product display is intended to rest.

7. A golf club fitting system comprising a table having a top surface having a first shape, and a product display positioned about a perimeter of the top surface and fitted thereto, the product display comprising a top panel having a second shape generally corresponding to the table top surface first shape, the product display further comprising a first vertical panel and a second vertical panel, the first and second vertical panels each having a top edge connected to the top panel, the first and second vertical panels being secured to each other along a common edge via a fastener, at least one of the vertical panels including a first bottomless longitudinal sleeve retaining a sample golf club shaft without a head having a distal end, the first bottomless longitudinal sleeve being positioned generally vertically above a lower pocket, the sample golf club shaft distal end being retained in the lower pocket, and at least one of said vertical panels including a second bottomless longitudinal sleeve retaining a sample golf club grip without a shaft via a friction fit.

8. The golf club fitting system of claim 7 wherein the first and second bottomless longitudinal sleeves are positioned proximate the top panel.

9. The golf club fitting system of claim 7 wherein at least one of the vertical panels includes the lower pocket, the lower pocket being aligned with at least one of the first and second bottomless longitudinal sleeves.

10. The golf club fitting system of claim 7 wherein at least one of the vertical panels comprises a grommet tab configured to permit attachment of the product display to an adjacent surface.

11. The golf club fitting system of claim 7 wherein at least one of the vertical panels comprises a pocket configured to retain promotional material therein.

12. The golf club fitting system of claim 7 wherein the top panel has a shape selected from the group comprising round, square, oval, elliptical, polygonal, a shape with both straight and curved segments, and rectangular.

13. The golf club fitting system of claim 7 wherein the top panel comprises a flexible material sized and shaped to substantially fit over the top surface.

14. The golf club fitting system of claim 7 wherein each of the first and second vertical panels comprises a flexible material.

* * * * *